US005772251A

United States Patent [19]

Fleck

[11] Patent Number: 5,772,251

[45] Date of Patent: Jun. 30, 1998

[54] INCOME TAX INFORMATION ORGANIZER

[76] Inventor: Gordon P. Fleck, 20 S. Clay, Hinsdale, Ill. 60521

[21] Appl. No.: 730,228

[22] Filed: Oct. 15, 1996

[51] Int. Cl.[6] ..... B42D 15/00

[52] U.S. Cl. ..... 283/115; 283/116; 283/66.1

[58] Field of Search ..... D19/3; 283/116, 283/66.1, 115; 229/68.1, 300

[56] References Cited

U.S. PATENT DOCUMENTS

| | | | |
|---|---|---|---|
| D. 321,007 | 10/1991 | Barrick | D19/3 |
| 352,585 | 11/1886 | St. John | 283/116 |
| 618,821 | 2/1899 | Barler | 229/68.1 |
| 4,669,651 | 6/1987 | Shaw et al. | 229/1.5 R |
| 4,717,176 | 1/1988 | Mathews | 281/15 R |
| 4,913,462 | 4/1990 | Parker | 281/15.1 |
| 4,964,656 | 10/1990 | Prentice | 281/44 |
| 4,971,363 | 11/1990 | Templet | 283/67 |
| 5,114,009 | 5/1992 | Johnston | 206/425 |
| 5,188,562 | 2/1993 | Carley | 462/54 |
| 5,277,451 | 1/1994 | Garza | 281/29 |

OTHER PUBLICATIONS

H & R Block Income tax Saver Envelope, Dec. 1967.

Jacobs Gardenr Office Supplies Catalog. p. 461,Item B, Dec. 1990.

*Primary Examiner*—Willmon Fridie, Jr.

*Attorney, Agent, or Firm*—Emrich & Dithmar

[57] ABSTRACT

An arrangement for recording and collecting federal and state income tax data and related documents includes a taxpayer personal information form, a tax preparer personal information form, and a plurality of specially marked envelopes, each adapted to hold a designated collection of tax related documents indicated on the envelope. For example, one envelope contains a list of sources of income for indicating and holding documents related to various sources of income, while a second envelope contains a list of deductions for indicating and holding deduction-related documents. The first envelope further includes a table with indicia for the entry of data related to gains and losses from the sale of property, stocks or bonds. A third envelope includes a list of other deductions and credits for indicating and holding documents related to any such other deductions and credits, as well as a list of proposed changes to the tax laws for indicating and holding documents related to any such proposed tax law changes. A stepwise instruction sheet indicating the manner in which the aforementioned envelopes and data entry forms are to be used is provided as well as a personal information form which, after being completed by the taxpayer, is placed in an addressed envelope together with the aforementioned envelopes upon which relevant income tax information has been entered and which hold tax-related documents for forwarding to an income tax return preparer. Each data entry form includes indicia for indicating for which category a tax-related document has been placed in the appropriate envelope to alert the tax return preparer of the existence and forwarding of any such documents.

10 Claims, 6 Drawing Sheets

Instruction Sheet

The national firm of Gordon Pierce Income Tax Services has made doing your taxes as easy as 1-2-3!

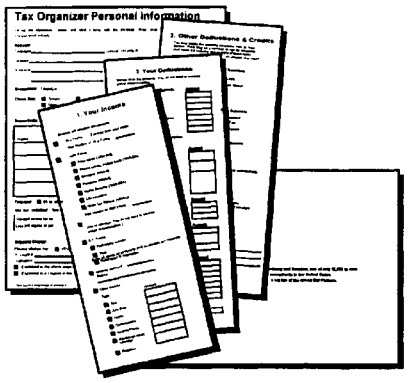

Simply fill out the personal information needed on the reverse side of this instruction sheet then use the enclosed envelopes to record your income, deductions and credits.

Mail all three envelopes and this instruction sheet back using the large envelope addressed to Gordon Pierce Income Tax Services and we will prepare your income tax return!

Deductions noted on these envelopes will adequately cover the tax needs of more than 90% of U.S. taxpayers. However, if you need additional forms or schedules, all are available from At Your Service during convenient shopping hours!

If you have questions, you may call our toll free number, 1-800-547-2259, during the hours of 9-6 Eastern Standard Time or from 9-noon EST on Saturdays. Follow the steps below and make doing this year's tax return painless!

Step 1 Record income information on outside of envelope #1 (red) and place forms you receive from employers, banks etc. as noted inside envelope.

Step 2 List medical expenses, interest you paid on your home etc. on outside of envelope #2 (white) and enclose forms inside envelope.

Step 3 If you have your own business, farm, or additional expenses and deductions, request the forms you need from At Your Service, fill them out, and enclose in the third envelope (blue print). Also include any info that may qualify you for new tax credits or deductions.

That's it! Be sure to complete the reverse side of this sheet and include it with the three envelopes and your payment. Gordon Pierce Income Tax Services will prepare your return and send it to you for your signature so you can mail it to the IRS!

☛ Remember, Gordon Pierce Income Tax Services offers a 100% guarantee on preparation of your return, including interest and penalties on your return! We have been doing returns for over 35 years, and we stand by our work!

✆ Questions? Call our toll-free number, 1-800-547-2259!

FIG. 1 10

Tax Organizer Personal Information

Fill out the information below and send it along with the enclosed three envelopes and your payment. Please print clearly.

Name(s):

Taxpayer_____ Social Security # ___-___-_____ Birthdate/Age _____

Spouse _____ Social Security # ___-___-_____ Birthdate/Age _____

Address _____ Home Telephone (____ )_____

_____ Work Telephone (____ )_____

Occupation: Taxpayer _____ Spouse _____

Check One: ☐ Single ☐ Married Filing Jointly ☐ Surviving Widow/Widower
☐ Married Filing Separately (enter spouse's name and Social Sec. # above)
☐ Unmarried Head of Household

Dependents

| Name | Birthdate/ Age | if age 1 or older, Social Sec. No. | Relationship | Number of months lived in your home during the last year |
|---|---|---|---|---|
| | | | | |
| | | | | |
| | | | | |
| | | | | |

Taxpayer: ☐ 65 or older ☐ Blind/Disabled Spouse: ☐ 65 or older ☐ Blind/Disabled Mail this completed form with the three envelopes and your payment using the enclosed return envelope.

| | |
|---|---|
| Standard income tax return package* | $50.00 |
| Less $10 deposit on package | - 10.00 |
| | 40.00 |
| Shipping Charge: | 5.00 |
| Total: | $45.00 |

Payment Form

Please charge my: ☐ VISA ☐ MasterCard

Account # _____ Exp. Date _____

Signature _____

☐ Enclosed is my check payable to Gordon Pierce in the amount of $_____

☐ Enclosed is a coupon in the amount of $ _____ which I have deducted from my total.

*There may be a nominal charge for additional schedules or more complex returns. If so, you will be notified of the total preparation fee before we prepare your return.*

12

FIG. 2

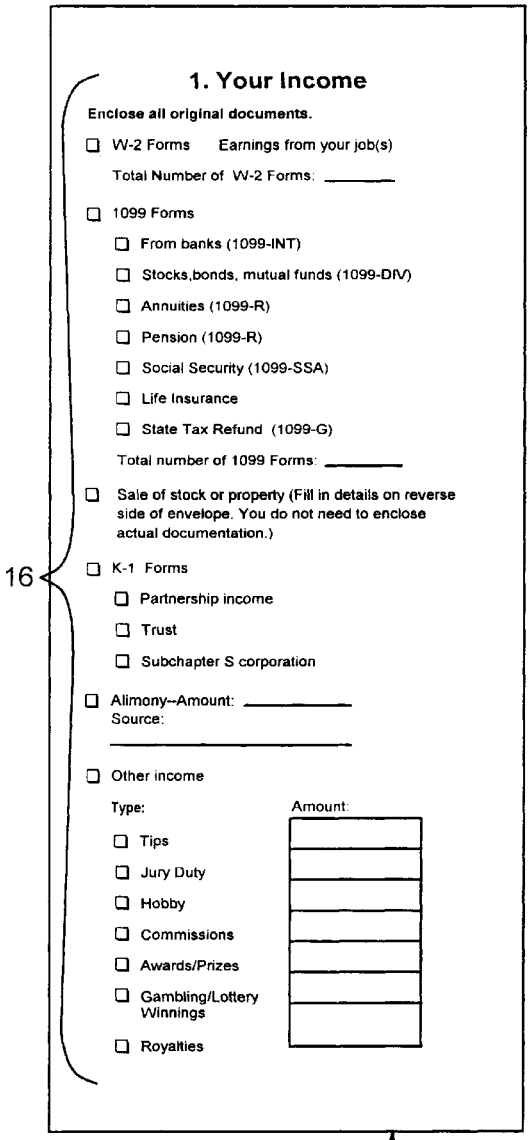
FIG.3a
FIG.3b
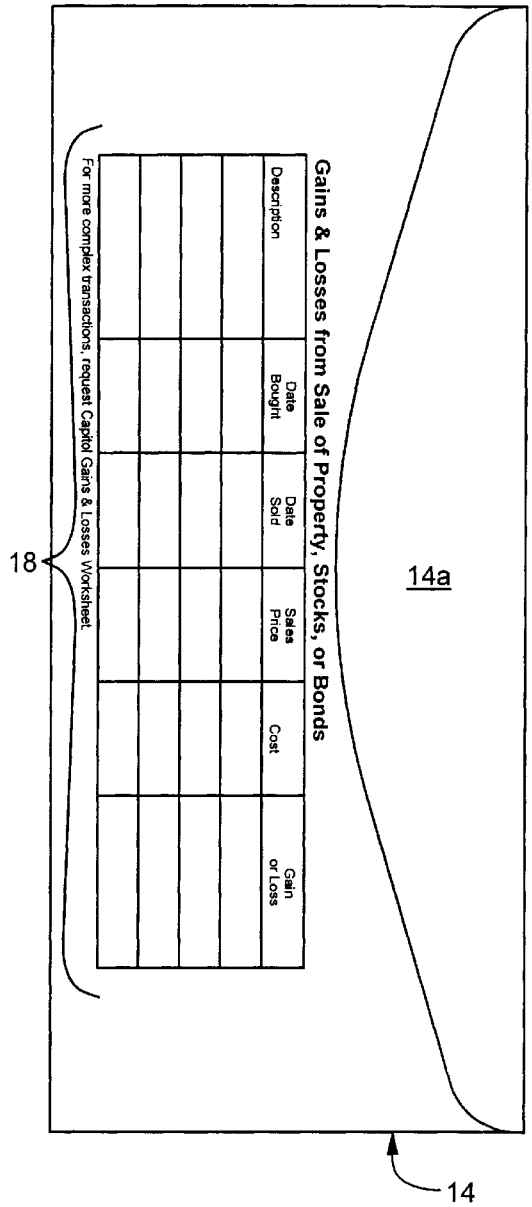

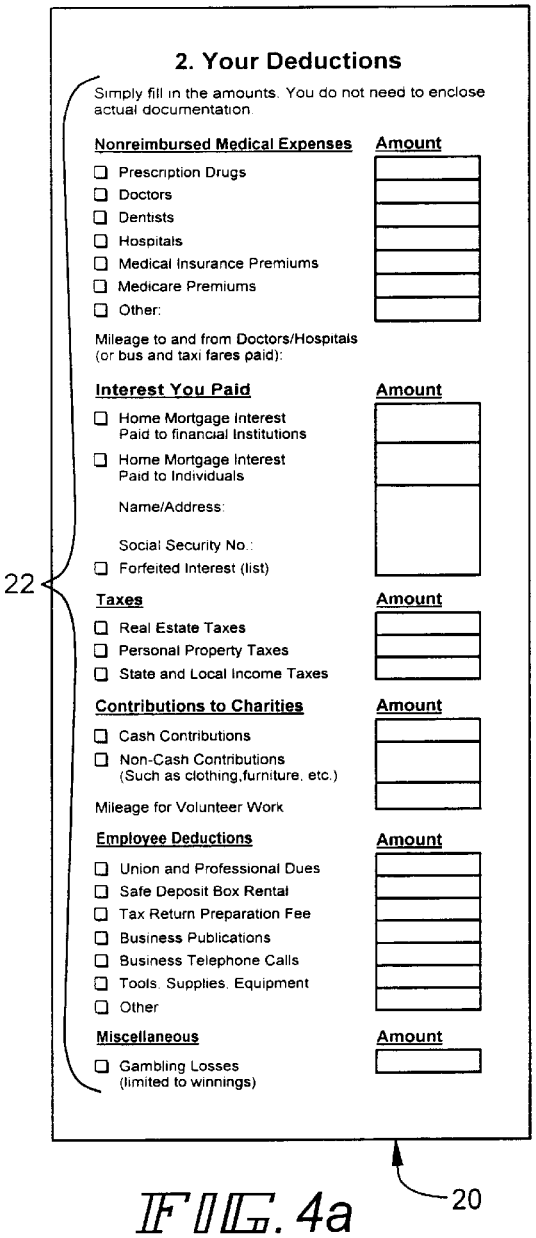
FIG. 4a
FIG. 4b
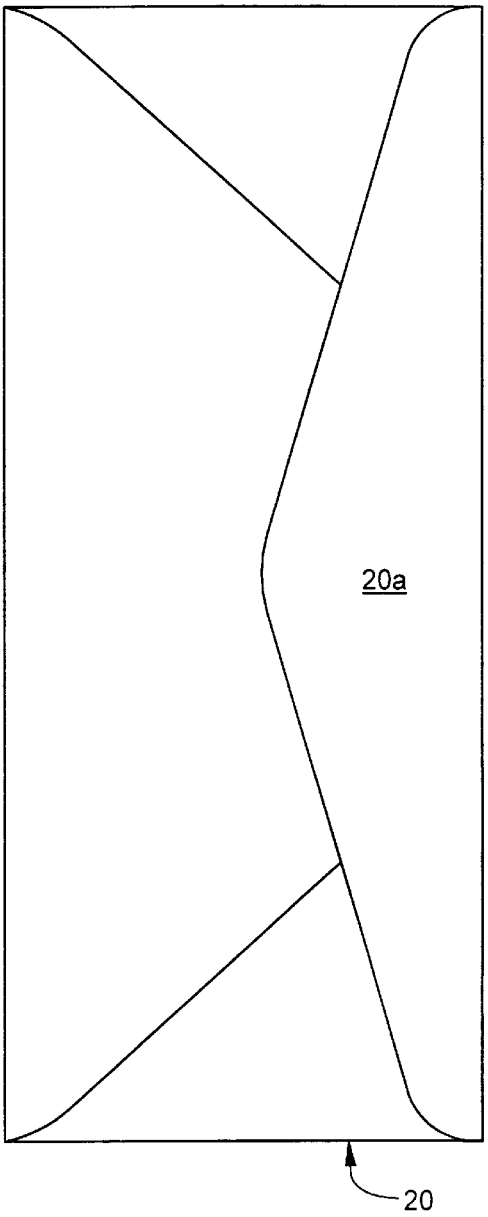

3. Other Deductions & Credits

You may obtain the following schedules from At Your Service. There may be a nominal charge for preparing your return if it includes one or more of these forms. If so, we will notify you before we prepare your return.

26

- ☐ Business Income & Expenses
- ☐ Capital Gains or Loss
- ☐ Sale of Your Home
- ☐ Sale of Business
- ☐ Rental Income
- ☐ Farm Income
- ☐ Credit for Dependent Care Expenses
- ☐ Credit for Elderly or Disabled
- ☐ Household Employment Tax
- ☐ Passive Activity Loss Carryover
- ☐ Moving Expenses
- ☐ Noncash Charitable Contributions
- ☐ Casualty & Theft Losses
- ☐ Money Spent for Your Job
- ☐ Kiddie Tax Once you have completed the additional schedule(s), place in this envelope.

28

New Changes to the Tax Code that Affect You

If you think you qualify for additional credits or deductions based on the most recent changes, check the box(es) below and place copies of relevant information in this envelope.

- ☐ College Tuition
- ☐ Flat Tax
- ☐ Capital Gains
- ☐ Other _____

Additional schedules are available. If you have questions or need additional schedules, call 1-800-547-2259.

24

FIG. 5a

FIG. 5b

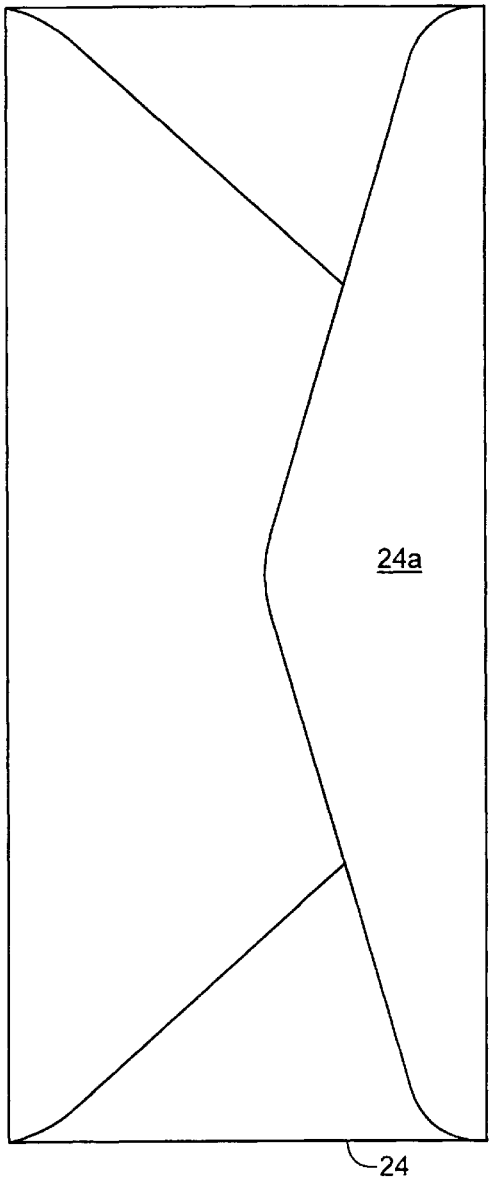

A Profile of Your Tax Preparer

PHOTO HERE

Barbara E. has 20 years of experience in tax preparation for both individuals and business accounts. She specializes in working with small to medium-sized businesses.

"Just thinking about doing their taxes gives many people anxiety attacks," Barb says. "But I enjoy working with numbers and putting things in order."

Because of her years of experience and familiarity with tax laws, Barb can often point out potential credits or deductions people have missed when doing their taxes.

"The tax laws have changed so much over the past 20 years," Barb points out. "It is difficult for the average citizen to keep up with the changes."

An alumni of DePaul University, Barb has successfully completed the requirements for nationally-recognized accreditation in taxation and is authorized to use the service mark, Accredited Tax Preparer SM of the Accreditation Council for Accountancy and Taxation, one of only 12,000 to earn this recognition of the estimated 900,000 accountants in the United States.

Barb enjoys bicycling and spectator sports in her free time and is a big fan of the Green Bay Packers.

Gordon Pierce Income Tax Services • 409 Main Street • Racine, WI 53403

30

FIG. 6

INCOME TAX INFORMATION ORGANIZER

FIELD OF THE INVENTION

This invention relates generally to the preparation of state and federal income tax returns and is particularly directed to an arrangement for recording data and collecting documents for forwarding to an income tax return preparer.

BACKGROUND OF THE INVENTION

The preparation of individual state and federal income tax returns is an annual occurrence of great importance to the individual taxpayer as well as to the federal government and the various state governments. Each year, millions of taxpayers meet with a tax return preparer for the purpose of providing relevant tax information needed in the preparation of the tax return. For convenience, this tax information is frequently provided to the tax preparer by mail or other form of delivery. When this occurs, the tax preparer typically first asks for and receives a copy of the individual's tax return for the previous year. This permits the tax preparer to solicit the relevant tax information for the current year in a form using a format specifically designed for the individual taxpayer. To date, there is no general set of forms or universally applicable system for recording relevant data and collecting appropriate documentation for use in preparing individual tax returns by mail.

The present invention addresses the aforementioned limitations of the prior art by providing an arrangement for recording and collecting federal and state income tax information and documentation which has general applicability to more than 90% of individual taxpayers and which allows for the preparation of individual tax returns by mail in a convenient, personalized and confidential manner.

OBJECTS AND SUMMARY OF THE INVENTION

Accordingly, it is an object of the present invention to facilitate the recording and collection of data and related documentation for use in the preparation and filing of state and federal income tax returns.

It is another object of the present invention to provide a series of forms and packets for the recording and collection of income tax data and information for use by an income tax return preparer.

It is yet another object of the present invention to provide an income tax information organizing arrangement for use in collecting, recording and forwarding income data and documents as well as personal information for use in the preparation of state and federal income tax returns.

This invention contemplates an arrangement for organizing, recording and collecting information for preparation and filing of an income tax return by an income tax return preparer, the arrangement comprising: an instruction sheet for a taxpayer with directions regarding the use of the arrangement; a first personal information form for the entry of personal data by the taxpayer; a first envelope including first and second data entry forms for holding documentation relating to information entered on the first and second data entry forms, wherein the first and second data entry forms are adapted to record data relating to income and to sales gains/losses, respectively; a second envelope including a third data entry form for holding documentation relating to information entered on the third data entry form, wherein the third data entry form is adapted to record data relating to deductions; a third envelope including fourth and fifth data entry forms for holding documentation relating to information entered on the fourth and fifth data entry forms, wherein the fourth and fifth data entry forms are adapted to record data relating to other deductions and credits and to proposed tax law changes, respectively; and a second personal information form containing information relating to the tax preparer for forwarding to the taxpayer with a completed income tax return.

BRIEF DESCRIPTION OF THE DRAWINGS

The appended claims set forth those novel features which characterize the invention. However, the invention itself, as well as further objects and advantages thereof, will best be understood by reference to the following detailed description of a is preferred embodiment taken in conjunction with the accompanying drawing, where like reference characters identify like elements throughout the various figures, in which:

FIG. 1 is an illustration of an instruction sheet for a user of the income tax information organizer of the present invention;

FIG. 2 is an illustration of a tax organizer personal information sheet to be completed by a user of the income tax information organizer of the present invention;

FIGS. 3*a* and 3*b* are respective plan views of opposing sides of a first envelope for use in the income tax information organizer of the present invention, where the first and second sides of the envelope include first and second data entry forms, respectively;

FIGS. 4*a* and 4*b* are plan views of respective opposed sides of a second envelope for use in the income tax organizer of the present invention, where one side of the envelope includes a third data entry form for completion by a user;

FIGS. 5*a* and 5*b* are plan views of first and second opposed sides of a third envelope for use in the income tax information organizer of the present invention, where one side of the envelope includes fourth and fifth data entry forms for completion by a user of the income tax information organizer of the present invention; and FIG. 6 is an illustration of a tax organizer personal information sheet to be completed by a tax preparer using the income tax information organizer of the present invention.

DETAILED DESCRIPTION OF THE PREFERRED EMBODIMENT

Referring to FIG. 1, there is shown an illustration of an instruction sheet 10 explaining the manner in which the income tax information organizer of the present invention is to be used. Instruction sheet 10 directs a user to complete the tax organizer personal information sheet 12 shown in FIG. 2 and to mail the three envelopes discussed in the instruction sheet as well as the tax organizer personal information form back to a tax return preparer in accordance with the present invention. Each of the three envelopes and associated data entry forms are described in detail below. Directions on the instruction sheet 10 further include a telephone number as well as a time of operation for calling the distributor of the income tax information organizer with questions or comments.

More specifically, the instruction sheet 10 lists step 1 in carrying out the present invention as recording income information on the outside of a first envelope 14 shown in FIGS. 3*a* and 3*b*. The user of the income tax information organizer is further directed to place all income related forms received from employers, banks, etc. in the first envelope 14. Step 2 outlined on the instruction sheet 10 directs the user of the income tax information organizer to list all medical expenses, interest paid on a home, etc., on the outside of a second envelope 20 shown in FIGS. 4*a* and 4*b*. The user is also directed to place the relevant forms relating to medical expenses, interest paid, etc., in the second envelope 20. The third step outlined on the instruction sheet 10 directs the user to list additional expenses and deductions such as related to operating a business or running a farm on a third envelope 24 shown in FIGS. 5*a* and 5*b*. The user is further directed to obtain the relevant forms for any expenses and deductions listed on the third envelope 24 and to complete any such forms and enclose them in the third envelope. The user is then directed to forward the three envelopes with the related income tax information and supporting documents to the income tax return preparer with the requisite payment.

As stated above, FIG. 2 is a representation of the tax organizer personal information form 12 for use by a user of the income tax information organizer. The tax organizer personal information form 12 includes such personal information as the user's name, social security number, birthdate, address, telephone number, occupation, and a list of dependents and relevant dependent information. Other information is requested on the tax organizer personal information form 12, as is a fee schedule and a space to indicate the manner in which the fee is to be paid.

First and second sides of the aforementioned first envelope 14 are respectively shown in FIGS. 3*a* and 3*b*. The first envelope 14 includes a flap 14*a* for enclosing relevant tax documents placed in the envelope for forwarding to the tax return preparer. The first side of the first envelope 14 includes a first data entry form 16 for listing all sources of income as well as the relevant tax form for each source of income. These sources of income and the relevant forms listed include earnings, interest, dividends, annuities, pensions, social security, life insurance, state tax refund, etc. Other sources of income of the vast majority of taxpayers are also listed in the first data entry form 16, such as partnership income, trust income, etc. A box is provided adjacent each source of income for checking off for the purpose of reviewing all possible sources of income for the user of the income tax information organizer arrangement as well as for indicating to the tax preparer which tax forms and relevant supporting documents have been placed in the envelope. On the facing, second side of the first envelope 14 is a second data entry form 18 for listing gains and losses from the sale of property, stocks or bonds. The second data entry form 18 includes a space for listing relevant information for each gain and loss entered on the form.

Referring to FIGS. 4*a* and 4*b*, there are respectively shown first and second sides of the aforementioned second envelope 20 for use in recording and collecting information for the preparation of an income tax return. The second envelope 20 includes a flap 20*a* as shown in FIG. 4*b* for closing the envelope after the relevant tax documents are inserted therein for forwarding to a tax return preparer. Disposed on the first surface of the second envelope 20 is a third data entry form 22 which includes a list of deductions as well as space for insertion of the dollar amount of the deduction. The list of deductions provided for in the third data entry form 22 includes non-reimbursed medical expenses, interest paid, tax paid, contributions to charities, employee deductions, and miscellaneous deductions, such as gambling losses. A block is provided for indicating the applicability of each type of deduction for the purpose of reviewing the various types of deductions for the user and for indicating to the tax preparer which tax forms and related supporting documentation have been placed in the second envelope 20.

Referring to FIGS. 5*a* and 5*b* there are respectively shown first and second opposed surfaces of a third envelope 24 for recording and collecting income tax information. The third envelope includes a flap 24*a* for sealing the envelope after the relevant tax documents have been inserted therein. The first surface of the third envelope 24 is provided with a fourth data entry form 26 for listing other taxpayer deductions and credits. The fourth data entry form 26 indicates that any such deductions and credits checked by the taxpayer should be accompanied by an associated tax form which are to be completed by the taxpayer, or user. The fourth data entry from 26 further instructs the taxpayer that once the additional tax schedules have been completed, they should be placed in the third envelope 24 for forwarding to the tax return preparer. Also provided on a lower portion of the first surface of the third envelope 24 is a fifth data entry form 28 for the entry of tax information related to proposed changes to the tax laws. The user of the income tax information organizer enters this information in anticipation of changes to the tax laws which affect the preparation of his or her income tax return.

Finally, shown in FIG. 6 is a tax preparer information form 30 which is forwarded to the taxpayer by the tax return preparer with the completed tax return. The tax preparer information form 30 includes personal information related to the tax preparer with which the taxpayer can identify for the purpose of making the income tax return preparation process more personal. The personal information of the tax preparer provided on the tax preparer information form 30 includes the tax preparer's phone number for permitting the taxpayer to reach the tax return preparer conveniently by phone with any questions or comments the taxpayer might have. Additional information on the tax preparer provided on the tax preparer information form 30 includes the tax preparer's name and education background.

There has thus been shown an arrangement for organizing, recording and collecting federal and state income tax information for use in the preparation of an income tax return. The income tax information organizer arrangement includes personal information forms for the taxpayer as well as for the tax return preparer, as well as a plurality of specially marked envelopes, each provided with one or more data entry forms for indicating the relevant tax information provided in each envelope. For example, one envelope contains a list of sources of income for indicating and holding documents related to various sources of income, while a second envelope contains a list of deductions for indicating and holding deduction-related documents. A third envelope includes a list of other deductions and credits for indicating and holding documents related to any such other deductions and credits, as well as a list of proposed changes to the tax laws for indicating and holding documents related to any such proposed tax law changes. A stepwise instruction sheet indicating the manner in which the aforementioned envelopes are to be used is provided, as well as instructions for forwarding the aforementioned envelopes containing the tax related documents to the income tax return preparer.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An arrangement for organizing, recording and collecting information for preparation and filing of an income tax return by an income tax return preparer, said arrangement comprising:

an instruction sheet for a taxpayer with directions regarding the use of the arrangement;

a first personal information form for the entry of personal data by the taxpayer;

first envelope means including first and second data entry forms for holding documentation relating to information entered on said first and second data entry forms, wherein said first and second data entry forms include respective first and second lists of the types of documents to be placed in said first envelope means and are adapted to record data relating to income and to sales gains/losses, respectively;

second envelope means including a third data entry form for holding documentation relating to information entered on said third data entry form, wherein said third data entry form includes a third list of the types of documents to be placed in said second envelope means and is adapted to record data relating to deductions;

third envelope means including fourth and fifth data entry forms for holding documentation relating to information entered on said fourth and fifth data entry forms, wherein said fourth and fifth data entry forms include respective fourth and fifth lists of the types of documents to be placed in said third envelope means and are adapted to record data relating to other deductions and credits and to proposed tax law changes, respectively; and a second personal information form containing information relating to the tax preparer for forwarding to the taxpayer with a completed income tax return.

2. The arrangement of claim 1 wherein said first, second and third envelope means are color coded.

3. The arrangement of claim 2 wherein said first, second and third envelope means are respectively red, white and blue.

4. The arrangement of claim 1 wherein said first data entry form includes means for defining a list of sources of income and a table for entering an income amount for each of said sources of income.

5. The arrangement of claim 4 wherein said first data entry form further includes means for defining indicia for indicating which of said sources of income are relevant for the taxpayer and for which of said sources of income documentation has been placed in said first envelope means.

6. The arrangement of claim 5 wherein said second data entry form includes means for defining a table for listing gains and losses from a sale of property, stock or bonds, and relevant data.

7. The arrangement of claim 1 wherein said third data entry form includes means for defining a list of deductions and a table for entering an amount for each of said deductions.

8. The arrangement of claim 7 wherein said third data entry form further includes means for defining indicia for indicating which of said deductions are relevant for the taxpayer and for which of said deductions documentation has been placed in said second envelope means.

9. The arrangement of claim 1 wherein said fourth data entry form includes means for defining a list of other deductions and credits and indicia for indicating which of said other deductions and credits are relevant for the taxpayer and for which of said other deductions and credits documentation has been placed in said third envelope means.

10. The arrangement of claim 9 wherein said fifth data entry form includes means for defining a list of proposed tax law changes with indicia for indicating which of said proposed tax law changes are relevant for the taxpayer and for which of said proposed tax law changes documentation has been placed in said third envelope means.

* * * * *